United States Patent [19]

Brindisi, Jr. et al.

[11] 4,302,246

[45] Nov. 24, 1981

[54] SOLUTION AND METHOD FOR SELECTIVELY STRIPPING ALLOYS CONTAINING NICKEL WITH GOLD, PHOSPHOROUS OR CHROMIUM FROM STAINLESS STEEL AND RELATED NICKEL BASE ALLOYS

[75] Inventors: Frank A. Brindisi, Jr., Madison; Thomas W. Bleeks, New Haven; Thomas E. Sullivan, Hamden, all of Conn.

[73] Assignee: Enthone, Incorporated, West Haven, Conn.

[21] Appl. No.: 109,248

[22] Filed: Jan. 3, 1980

[51] Int. Cl.[3] ..... C23F 1/00; C22B 7/00

[52] U.S. Cl. ..... 75/101 R; 134/3; 156/656; 156/664; 156/637; 252/79.4; 252/146; 252/364

[58] Field of Search ..... 156/637, 640, 656, 664; 75/97 R, 97 A, 101 R, 104, 119, 121; 252/79.2, 79.4, 146; 134/3, 41

[56] References Cited

U.S. PATENT DOCUMENTS 2,200,486 5/1940 Burdick ..... 75/101 R 3,125,475 3/1964 Livingston et al. ..... 156/664

*Primary Examiner*—William A. Powell

*Attorney, Agent, or Firm*—DeLio and Montgomery

[57] ABSTRACT

Improved solutions are provided for selectively stripping alloys containing nickel with gold, phosphorous or chromium from substrates formed from alloys containing iron with chromium and in some instances nickel, or nickle rich, chromium bearing alloys, some of which also contain iron. These solutions comprise concentrated nitric acid, at least one chloride salt, an organic corrosion inhibitor and, optionally, an organic surface active agent. An improved method utilizing the solutions of the invention is also provided and facilitates stripping of these alloys in substantially reduced time, without degradation of the underlying substrate.

22 Claims, No Drawings

SOLUTION AND METHOD FOR SELECTIVELY STRIPPING ALLOYS CONTAINING NICKEL WITH GOLD, PHOSPHOROUS OR CHROMIUM FROM STAINLESS STEEL AND RELATED NICKEL BASE ALLOYS

BACKGROUND

The invention relates to chemical removal of alloys containing nickel with gold, phosphorous or chromium from stainless steel or nickel base alloy substrates. More particularly, the invention relates to selective stripping of a gold/nickel, nickel/phosphorous or nickel/-chromium alloy from substrates which are formed from 300 to 400 series Stainless Steels or nickel rich, chromium bearing alloys, such as Hastelloy, Inconel or equivalent alloys.

Alloys of gold and nickel, which typically range from between 70% to 80% gold and 18% to 30% nickel are conventionally utilized as a braze to join substrates, such as ferrous and nickel alloys in applications requiring structural strength, yet resistance to extreme heat. Gold/nickel brazing alloys have a melting point in excess of 1000° F. (537.8° C.), and are applied in varying thicknesses by melting a paste or pre-formed segment with flux. In some applications, alloys of nickel (97% to 85%) and phosphorous (3% to 15%) are used, either as brazing alloys or coatings. Nickel/chromium alloys may be applied as a flame spray, or plasma spray, coating. Removal, or "stripping", which is required to disassemble or inspect parts attached or coated with such alloys is preferably accomplished by chemical techniques, rather than by reheating.

While the present invention is not limited to any particular application employing brazing or coating alloys, either of gold/nickel, nickel/phosphorous or nickel/chromium, it is, however, most preferably and advantageously utilized to selectively strip such brazing alloys when used to join segments of internal components of jet engines. For example, gold/nickel brazing alloys are used to secure airfoil vanes in stators used in the turbine section of a jet engine. These are stationary parts, downstream of the combustion chamber, which are exposed to extremely high temperatures and stress. However, mandatory maintenance and inspection procedures require that such components are routinely removed, either for inspection or replacement. While it is necessary to selectively strip the gold/nickel alloy from these components, it must be done in a manner which will not adversely effect, or degrade, the substrate alloys from which the stators or other components are formed. Typically, alloys of iron with chromium and in some instances nickel, and nickel rich, chromium bearing alloys, some of which also contain iron, are used to make such components; for example, Stainless Steel, Hastelloy, Inconel or equivalent alloys.

Furthermore, the time required to complete stripping of the brazing alloy from jet engine components, in particular, is of great importance, in view of the fact that the aircraft may be out of service during such procedures.

Prior art techniques for chemically stripping gold-/nickel brazing alloys, for example, involve methods employing a series of steps and various chemical solutions. In order to remove sufficient brazing alloy, a substantial amount of time was required, typically as much as 9 to 18 days. However, with use of ultrasonic agitation, this time could be reduced to 3 to 5 days.

Furthermore, prior art techniques present disadvantages due to employing either substantial amounts of electric current, or use of aqueous solutions containing cyanides, and/or nitro-substituted aromatic compounds and chelating agents, with the resulting toxicity and environmental problems. Finally, prior art methods usually required operation at elevated temperatures, typically ranging from 100° to 185° F. (37.8° to 85° C.).

Exemplary of prior art techniques for removal of brazing alloys containing gold are those set forth in U.S. Pat. No. 3,819,494 and No. 3,958,984. However, the methods provided in accordance with these patents involve the aforementioned disadvantages, particularly with regard to use of cyanides, and are extremely slow in comparison to the present invention.

Another conventionally available gold/nickel braze stripping solution contains concentrated nitric acid, with copper, iron and sodium chlorides. Not only is its action very slow, in comparison with the present invention, but pitting and degradation of the substrate alloy is a problem, particularly with longer exposure times. The substantially longer exposure required for removal of the braze by prior art solutions renders the substrate much more susceptible of attack on the Stainless Steel alloys, with resultant pitting, "smutting" or degradation caused by intergranular attack.

In accordance with the present invention, an improved solution is provided, which, used by itself in preferred embodiments, is fully operable to strip gold-/nickel,nickel/phosphorous or nickel/chromium alloys from substrates formed from 300 and 400 series Stainless Steels, Hastelloys, Inconels and equivalent alloys. The novel solution of the invention, and method provided for utilizing the same to strip these brazing or coating alloys, is operable to remove the alloy in substantially less time than is possible with prior art techniques or solutions, and without adversely effecting or degrading the underlying substrate. The novel solution and method of the invention have particular utility for selectively stripping gold/nickel brazing alloys used in jet engines, where minimal time and avoidance of degradation of the underlying substrate is of utmost importance and criticality.

The improved solutions of the invention provide a wide range of operational utility, particularly with respect to temperature of treatment baths, or sprays, which while preferably operable at ambient temperatures, must also be capable of operation at higher temperatures. This is particularly advantageous because it permits use of ultrasonic agitation which tends to raise the temperature, as a result of the conversion of electrical to mechanical energy.

SUMMARY OF THE INVENTION

In accordance with the present invention, an improved solution is provided for selectively stripping alloys containing nickel with gold, phosphorous or chromium from substrates formed from alloys containing iron with chromium and in some instances nickel, or nickel rich, chromium bearing alloys such as Hastelloys, Inconel or equivalent alloys. The improved solution contains concentrated nitric acid, chloride ions supplied from one or more chloride salts, an organic corrosion inhibitor effective to inhibit degradation of the substrate and, preferably, an organic surface active agent, compatible with and effective to reduce the surface tension of the solution and, preferably contributing additional corrosion inhibition.

The organic corrosion inhibitor is an acetylenic alcohol, preferably 2-butyne 1,4 diol, ethoxylated butyne, 1,4 diol or propargyl alcohol, and the organic surface active agent is a polyethoxylated amine or diamine, preferably polyoxyethylene cocamine, polyoxyethylene soyaamine, polyoxyethylene oleylamine, polyoxyethylene octadecylamine or N,N',N'-polyoxyethylene (15)-N-tallow 1,3 diaminopropane.

In accordance with the invention, a method is provided for stripping nickel containing alloys with gold, phosphorous or chromium comprising application of an improved solution of the invention to a coated substrate formed of an alloy containing iron with chromium and in some instances nickel, or nickel rich, chromium bearing alloy, such as Hastelloy, Inconel or equivalent alloys. Application is, preferably, by immersion or spraying, with removal of the brazing or coating alloy completed within about 2 to 24 hours, at a temperature of 70° to 130° F. (21.1° to 24.4° C.). The method may further include exposure of the substrate and/or solution to agitation, either mechanical or, preferably, ultrasonic, in order to further increase the stripping speed.

In accordance with the present invention, gold-/nickel, nickel/phosphorous or nickel/chromium alloys may be selectively stripped from substrates utilized in structural components of jet engines more efficiently than possible using prior art materials or techniques, but without degradation of the substrate alloy.

Accordingly, it is an object of the invention to provide an improved solution for selectively stripping gold/nickel, nickel/phosphorous or nickel/chromium alloys, in particular, from substrates preferably formed from 300 to 400 series Stainless Steels or Hastelloy, Inconel or equivalent alloys over a wide range of operating parameters, particularly temperature and concentration of chloride ions, without adverse effect upon or degradation of the substrate, in substantially less time than is presently possible utilizing prior art solutions or techniques.

It is an object of the invention to provide an improved method for selectively stripping such alloys, which is particularly adaptable to removal thereof from internal components of jet engines and the like, and is capable of accomplishing stripping without degradation of the substrate alloys and in substantially less time than conventionally possible.

It is a further object of the invention to provide an improved solution and method for selectively stripping such alloys which, either with or without mechanical or ultrasonic agitation, are capable of effecting stripping in substantially less time than conventionally possible.

It is yet another object of the invention to provide a solution and method for selectively stripping such alloys, which facilitate subsequent recovery of the gold, phosphorous, chromium and/or nickel components, using conventional recovery techniques.

It is yet a further object of the invention to provide an improved solution and method for selectively stripping such alloys which possess a commercially advantageous wide range of operational capabilities, particularly as to time and temperature, and which avoid the toxcity, environmental disposal, and pollution disadvantages involved in use of cyanides, and which do not require use of multiple solutions or treatments, as in the prior art.

DESCRIPTION OF PREFERRED EMBODIMENTS AND THE BEST MODE FOR CARRYING OUT THE INVENTION

In accordance with preferred embodiments of the present invention, a novel solution is provided which has utility for stripping alloys containing nickel with gold, phosphorous to chromium, preferably gold/nickel or nickel/phosphorous alloys, from substrates formed from alloys containing iron with chromium and in some instances nickel, or nickel rich, chromium bearing alloys, some of which also contain iron. This novel stripping solution has been found to cause little, if any, degradation of the substrate, particularly with regard to intergranular attack of 410 Stainless Steel. Therefore, it is particularly useful to remove gold/nickel or nickel/-phosphorous braze or coating from critical structural components which are subjected to high levels of temperature and/or stress.

It is, however, fully within the purview of the invention that the substrate from which the alloy is stripped, or removed, is not a limiting factor. Likewise, the configuration, shape or size of a component from which these alloys can be removed in accordance with the invention is not limited. However, the configuration, shape or size of the substrate may effect the time or particular manner of application of the improved solutions of the invention, as will be readily apparent to one skilled in the art.

It has been found that the improved solutions and method of the invention can be used with particular advantage to remove gold/nickel alloys from substrates formed of Stainless Steel, preferably 300 to 400 series Stainless Steels, Hastelloy, Inconel or equivalent alloys. However, it is fully within the purview of the invention that other related high-temperature nickel-containing alloys, such as nickel/phosphorous or nickel/chromium alloys, which may be used either as a coating or a braze in high-temperature applications, can also be effectively stripped from such substrates. Therefore, it is to be understood that reference herein to "gold/nickel alloys" also includes such other nickel-containing alloys, particularly nickel/phosphorous or nickel/chromium alloys.

In one preferred embodiment, an improved solution of the invention is comprised of concentrated nitric acid, chloride ions from at least one salt, an organic corrosion inhibitor which is effective to inhibit degradation of the substrate from which the gold/nickel alloy is removed, and an organic surface active agent which is compatible with and effective to reduce the surface tension of the solution and, preferably contributes additional corrosion inhibition.

Preferably, nitric acid having concentration ranging from between about 40% to 72%, by weight, in aqueous solution is utilized. Nitric acid having a concentration less than about 40%, while functional, generally produces a rate of braze removal which is unacceptably slow. Use of nitric acid in a concentration of less than about 40% in aqueous solution is also undesirable, because the increased water content tends to lessen passivity, particularly of substrates made of Stainless Steel alloys, and increases the likelihood of adverse effects on the substrate or degradation of the substrate alloy. Nitric acid above about 72%, by weight, can be used, but is is normally unavailable in quantity or commercial grades.

In accordance with the invention, a working solution is preferably prepared by admixture of the other components to be concentrated nitric acid, on the basis of grams per liter of nitric acid.

Chloride ions are provided in the improved solution of the invention from at least one chloride salt and, preferably, an inorganic chloride salt such as alkali metal chlorides, particularly potassium chloride, ferric chloride, calcium chloride, nickel chloride, magnesium chloride, aluminum chloride, or combinations thereof. The total chloride ion concentration should be at least 3.75 grams per liter of concentrated nitric acid and preferably ranges between about 3.75 to 90 grams per liter and, more preferably between 15 to 27.5 grams per liter.

In one embodiment of the invention, chloride ions are provided from potassium chloride and ferric chloride, used in combination. The potassium ferric ion concentration each sould be at least 3.75 grams per liter of concentrated nitric acid and preferably may range between about 3.75 to 60 grams per liter and, most preferably, between about 7.5 to 15 grams per liter. It is fully within the purview of the invention that potassium and/or ferric ion can also be supplied from potassium and/or ferric salts other than chloride salts; for example, from potassium nitrite, potassium iodate, potassium sulfate, potassium metaphosphate, potassium periodate, potassium selenate, potassium citrate, potassium tartrate or ferric nitrate, ferric sulfate or ferric phosphate, respectively.

Potassium chloride is most preferably used in accordance with the invention, because of its greater solubility characteristics, which allow it to provide higher levels of chloride ion in solution than other chloride salts, for example, sodium chloride. Furthermore, it is believed that the presence of potassium ions in the solutions of the invention enhance the solubility of gold, as the braze is stripped from the substrate.

It is also preferred to use ferric chloride as a source of chloride ions, most preferably in conjunction with potassium chloride. It is believed that ferric ion may beneficially function as a secondary oxidizer, in addition to nitric acid, the primary oxidizing agent. Furthermore, it is believed that the presence of ferric ions in the working solutions of the inventin may further accelerate stripping of the brazing alloy, by acting as an electrical coupling agent to establish an electromotive force which contributes to removal of the brazing alloy.

It has been found that use of hydrochloric acid, particularly as a sole source of chloride ions, is undesirable and results in a stripping solution which is inoperable in accordance with the present invention. Although a gold/nickel brazing alloy can be stripped using hydrochloric acid as the source of chloride ion, the substrate alloy is subjected to severe attack and degradation. Accordingly, substantial amounts of hydrochloric acid should be avoided in the improved stripping solutions of the invention, although it may be permissible to incorporate minor amounts to the extent that its presence does not adversely effect or degrade the substrate alloy.

Copper chloride has been found to cause problems, particularly with pitting of the substrate alloy, which is believed to result from the galvanic effect of the presence of copper ions and ferric metal. Accordingly, the presence of copper ions, particularly in the form of copper chloride, in the improved solutions of the invention should be avoided, although its presence may be tolerated if it does not adversely effect or degrade the substrate alloy.

The organic corrosion inhibitors used in the stripping solutions of the invention are acetylenic alcohols and, preferably, 2-butyne 1,4 diol, ethoxylated butyne, 1,4 diol or propargyl alcohol. The organic corrosion inhibitor must be effective to inhibit degradation of the substrate by the stripping solutions of the invention, in view of the fact that they contain strong oxidizing agents. Preferably, the organic corrosion inhibitor is provided in a concentration ranging from about 1 to 30 grams per liter, based on the amount of nitric acid, and, most preferably, between about 1 to 3 grams per liter. The corrosion inhibitors are believed to contribute not only to the operability of the stripping solution in substantially reduced times of exposure, without degradation or adverse effect upon the substrate, but they also allow for operation over a wider range of temperature and concentration of chloride ion.

In accordance with the invention, an organic surface active agent which is compatible with the working solution and effective to reduce surface tension and, preferably contribute additional corrosion inhibition, is provided in the working solution, preferably in a concentration ranging from about 1 to 30 grams per liter, based upon the amount of nitric acid present, and, most preferably, in a concentration ranging from about 1.0 to 3.0 grams per liter. Preferably, a polyethoxylated amine or diamine, for example polyoxyethylene cocoamine, polyoxyethylene soyaamine, polyoxyethylene oleylamine, polyoxyethylene octadecylamine or N,N',N'-polyoxyethylene (15)-N-tallow 1,3 diaminopropane, may be utilized as the organic surface active agent. Not only do these surface active agents appear to maintain the solubility of the corrosion inhibitor, but they also appear to have a synergistic effect, in combination with the organic corrosion inhibitor, to provide improved protection against intergranular attack or degradation of the substrate alloys.

In accordance with the method of the present invention, a working solution of any of the preferred embodiments is prepared and applied to the substrate, in a manner which facilitates physical removal of the products of the gold/nickel alloy from the area of the surface of the brazed or coated substrate. Preferably, the substrate is immersed in, or sprayed with, a working solution of the invention at a temperature ranging between about 50° to 130° F. (10° to 54.4° C.), and, preferably, between about 70° to 115° F. (21.1° to 46.1° C.). Stripping time will vary depending upon the configuration of the substrate, thickness of the brazing or coating alloy, concentration of the solution constituents, temperature and the type of agitation, if any, which is used. Generally, stripping will be completed within 2 to 24 hours, when using ultrasonic agitation. Without use of ultrasonics, stripping times range between about 10 to 120 hours.

It should be understood that while the solution and method of the invention are fully operable without use of ultrasonics, the time required to effect removal of the braze alloy is reduced by a factor of about 5 when ultrasonics are applied. Furthermore, when ultrasonics are used, while the conversion of electrical to mechanical energy by the ultrasonic transducer tends to heat the operating solution, this does not adversely effect or degrade the substrate alloy being treated in accordance with the invention.

In accordance with the invention, it is possible to selectively strip gold/nickel brazing or coating alloys using conventional waxes or other inexpensive masks, to coat areas of the substrate which do not require stripping. For example, a substrate having portions brazed with gold/nickel alloy may be first dipped in a wax which, following solidification, can then be selectively removed from areas having the brazing alloy. The substrate is then treated with a solution of the invention to effect removal of the braze. Use of such masking materials, while not necessary in all instances, is nevertheless preferred in many applications, because of the added degree of protection afforded to non-brazed substrate parts from the strong oxidizing materials contained in the stripping solution.

EXAMPLES

In order to illustrate more fully the improved solutions and method of the invention, the following examples are set forth, but do not limit the scope of the invention. Examples 1 to 3 were conducted to demonstrate the operability of the preferred organic corrosion inhibitors of the invention under laboratory conditions and did not include an organic surface active agent, due to the low temperatures used and limited operating parameters used for this evaluation.

EXAMPLE 1

A working solution was prepared by admixture of the following:

concentrated nitric acid (70%, 42° Be): 1 liter
potassium chloride: 19 grams
ferric chloride: 19 grams
2-butyne 1, 4 diol: 1.65 grams This solution contained 21 grams per liter of chloride ion. A specimen, comprising two strips of 410 Stainless Steel, each 1 inch by 1 inch by 0.0625 inches, joined to form a "T" with a braze of gold/nickel alloy, containing 80% gold and 20% nickel, was immersed in the solution for 30 minutes. An ultrasonic transducer was used to administer ultrasonic agitation. The solution temperature ranged from between 70° to 78° F. (21.1° to 25.6° C.), with an average temperature of 74° F. (23.3° C.).

Inspection of the specimen after 30 minutes revealed 100% removal of the gold/nickel braze, without attack or degradation of the specimen substrate.

EXAMPLE 2

A working solution was prepared by admixture of the following:

concentrated nitric acid (70%, 42° Be): 1 liter
potassium chloride: 19 grams
ferric chloride: 19 grams
ethoxylated butyne 1,4 diol: 3.16 grams The ethoxylated butyne 1,4 diol was used comprised of butyne 1,4 diol ethoxylated with ethylene oxide in a ratio of ethylene oxide to butyne diol of 1.8:1.0.

This working solution contained 21 grams per liter of chloride ion. A specimen, comprising two strips of 410 Stainless Steel, each 1 inch by 1 inch by 0.0625 inches, joined to form a "T" and brazed with a gold/nickel alloy containing 80% gold and 20% nickel, was immersed in the solution for 30 minutes. An ultrasonic transducer was used to administer ultrasonic agitation. The temperature ranged from between 66° to 76° F. (18.9° to 24.4° C.), with an average temperature of 71° F. (21.7° C.).

Inspection of the specimen after 30 minutes revealed 100% removal of the gold/nickel braze, without attack or degradation of the specimen substrate.

EXAMPLE 3

A working solution was prepared by admixture of the followig:

concentrated nitric acid (70%, 42° Be): 1 liter
potassium chloride: 19 grams
ferric chloride: 19 grams
propargyl alcohol: 1.07 grams This working solution also contained 21 grams per liter of chloride ion. A specimen, similar to those used in Examples 1 and 2, was immersed in the solution for 30 minutes. Ultrasonic agitation was again administered and the temperature ranged from between 70° to 74° F. (21.1° to 23.3° C.), with an average temperature of 74° F. (23.3° C.).

Inspection of the specimen after 30 minutes revealed 98% removal of the gold/nickel braze, with attack or degradation of the specimen substrate.

EXAMPLE 4

A working solution, in accordance with the invention, was prepared comprising the following:

nitric acid (70%, 42° Be): 1 liter
potassium chloride: 18 grams
ferric chloride, anhydrous: 18 grams
2-butyne 1,4 diol: 1.6 grams
N,N',N'-polyoxyethylene (15)-N-tallow 1,3 diaminopropane: 2.1 grams A speciman similar to those used in Examples 1 to 3 was immersed in the working solution at a temperature ranging between 98° to 118° F. (36.7° to 47.8° C.). However, ultrasonic agitation was not employed and after 70 minutes only half of the gold/nickel brazing alloy was removed, with no visual attack of the specimen substrate.

After 7 hours and 50 minutes, 95% of the braze was removed, again without visual evidence of attack or degradation of the segment substrate. Using the same working solution, however, with the addition of ultrasonic agitation, like specimens were completely stripped in 45 minutes, with the temperature ranging between 80° to 100° F. (26.7° to 37.8° C.).

EXAMPLE 5

For purposes of comparison, the following solution of nitric acid and hydrochloric acid was prepared to demonstrate the unsatisfactory performance of such solutions, due to their attack upon and degradation of the substrate alloy. 56 grams of hydrochloric acid (37%, AR grade) was admixed with 1 liter of concentrated nitric acid (70°, 42° Be), yielding a chloride ion concentration of 20 grams per liter. A specimen similar to those used in the other examples was immersed, with ultrasonic agitation, in this solution at a temperature ranging from between 66° to 81° F. (18.9° to 27.2° C.). After 15 minutes, severe attack was observed on the specimen substrate. After a total of 45 minutes, while effectively all of the gold/nickel brazing alloy was removed, the specimen substrate was severely attacked and degraded.

Although the preceding Examples are presented solely for purposes of illustration, it is to be understood that such solutions and methods for selectively stripping alloys containing nickel with gold, phosphorous or chromium in accordance with the invention may be altered, varied or modified without departing from the spirit or scope of the invention as defined by the appended claims.

What is claimed is:

1. An improved solution for selectively stripping an alloy containing nickel with gold, phosphorous or chromium from substrates formed from alloys containing iron with chromium alone or with nickel, or nickel rich, chromium bearing alloys, said solution comprising:

(a) concentrated nitric acid;

(b) chloride ions from at least one chloride salt; and (c) an organic corrosion inhibitor effective to inhibit degradation of said substrate by said solution.

2. The improved solution of claim 1 further including an organic surface active agent, said agent being compatible with and effective to reduce the surface tension of said solution.

3. The improved solution of claim 2 wherein said surface active agent further contributes to corrosion inhibition of said solution.

4. The improved solution of claim 1 wherein said concentrated nitric acid ranges from about 40% to 72% by weight aqueous solution.

5. The improved solution of claim 1 wherein said chloride salt is an inorganic chloride selected from the group consisting of alkali metal chlorides, ferric chloride, calcium chloride, nickel chloride, aluminum chloride or magnesium chloride.

6. The improved solution of claim 5 wherein said chloride salt is ferric chloride or potassium chloride.

7. The improved solution of claim 1 wherein said organic corrosion inhibitor is an acetylenic alcohol.

8. The improved solution of claim 7, wherein said organic corrosion inhibitor is selected from 2-butyne 1,4 diol, ethoxylated butyne 1,4 diol or propargyl alcohol.

9. The improved solution of claim 2 wherein said organic surface active agent is selected from polyethoxylated amines or diamines.

10. The improved solution of claim 9 wherein said organic surface active agent is either polyoxyethylene cocamine, polyoxyethylene soyaamine, polyoxyethylene oleylamine, polyoxyethylene octadecylamine or N,N',N'-polyoxyethylene (15)-N-tallow 1,3 diaminopropane.

11. The improved solution of claim 1 wherein said substrates are formed from alloys selected from 300 or 400 series Stainless Steels, Hastelloy, Inconel or equivalent alloys.

12. The improved solution of claim 11 wherein said substrate is formed from 410 Stainless Steel.

13. An improved solution for selectively stripping gold/nickel brazing alloys from a substrate formed from 300 or 400 series Stainless Steels, Hastelloy, Inconel or equivalent alloys, said solution comprising:

(a) nitric acid in a concentration ranging from about 40% to about 72% by weight;

(b) potassium ion in a concentration ranging from about 3.75 to 60 grams per liter of nitric acid;

(c) chloride ion in a concentration ranging from about 3.75 to about 90 grams per liter of nitric acid;

(d) ferric ion in a concentration ranging from about 3.75 to 60 grams per liter of nitric acid;

(e) a polyethoxylated amine or diamine in a concentration ranging from about 1.0 to 30 grams per liter of nitric acid; and (f) an acetylenic alcohol in a concentration ranging from about 1.0 to 30 grams per liter of nitric acid.

14. An improved solution for selectively stripping gold/nickel, nickel/phosphorous or nickel/chromium alloy from a substrate formed from 300 or 400 series Stainless Steels, Hastelloy, Inconel or equivalent alloys, said solution comprising nitric acid in a concentration ranging from about 40% to 72% by weight, potassium ion in a concentration ranging from 7.5 to 15 grams per liter of nitric acid, chloride ions ranging between about 15 to 27.5 grams per liter of nitric acid, ferric ion in a concentration ranging from about 3.75 to 15.0 grams per liter of nitric acid, an acetylenic alcohol ranging from about 1.0 to 3.0 grams per liter of nitric acid, and a polyethoxylated amine or diamine ranging from about 1.0 to 3.0 grams per liter of nitric acid.

15. The improved solution of claim 14 wherein said potassium ion is provided in solution from potassium compounds selected from the group consisting of potassium nitrate, potassium iodate, potassium sulfate, potassium metaphosphate, potassium periodate, potassium selenate, potassium citrate or potassium tartrate, said chloride ion is provided from a chloride compound selected from the group consisting of sodium chloride, potassium chloride, lithium chloride, calcium chloride, nickel chloride, aluminum chloride, or magnesium chloride, and said ferric ion is provided by a ferric compound selected from the group comprising ferric nitrate, ferric sulfate or ferric phosphate.

16. An improved method for selectively stripping brazing or coating alloy containing nickel with gold, phosphorous or chromium from substrates formed from alloys containing iron with chromium alone or with nickel, or nickel rich, chromium bearing alloys, comprising application by immersion or spraying of the improved solution of claim 1 to said substrate, at a temperature ranging from about 70° to 130° F., for between 2 to 24 hours, until said brazing or coating alloy is removed from said substrate.

17. The method of claim 16 further including application of ultrasonic agitation to said substrate.

18. An improved method for selectively removing gold/nickel, nickel/phosphorous or nickel/chromium alloy from substrates formed from 300 or 400 series Stainless Steels, Hastelloy, Inconel or equivalent alloys, said method comprising the steps of:

(a) preparation of a working solution from concentrated nitric acid, one or more chloride salts selected from the group consisting of alkali metal chlorides, ferric chloride, aluminum chloride, calcium chloride, nickel chloride or magnesium chloride, an acetylenic alcohol and a polyethoxylated amine or diamine, and (b) application of said working solution to said substrate, at a temperature ranging between 70° to 130° F., for between 2 to 24 hours.

19. The method of claim 18 further including application of ultrasonic agitation to said substrate.

20. The method of claim 18 wherein said acetylenic alcohol is selected from 2-butyne, 1,4 diol, ethoxylated butyne 1,4 diol or propargyl alcohol.

21. The method of claim 18 wherein said polyethoxylated amine or diamine is either polyoxyethylene cocamine, polyoxyethylene soyaamine, polyoxyethylene oleylamine, polyoxyethylene octadecylamine or N,N',N'-polyoxyethylene (15)-N-tallow 1,3 diaminopropane.

22. The method of claim 18 wherein said nitric acid ranges from about 40% to 72% by weight aqueous solution and said chloride salt is added in an amount to provide chloride ions in an amount of at least 3.75 grams per liter of said nitric acid.

* * * * *

UNITED STATES PATENT AND TRADEMARK OFFICE

CERTIFICATE OF CORRECTION

PATENT NO. : 4,302,246

DATED : November 24, 1981

INVENTOR(S) : Frank Brindisi, Jr. et al

It is certified that error appears in the above-identified patent and that said Letters Patent are hereby corrected as shown below:

Column 8, line 20

Delete "with" and insert "without"

Signed and Sealed this

Thirtieth Day of March 1982

[SEAL]

Attest:

GERALD J. MOSSINGHOFF

Attesting Officer

Commissioner of Patents and Trademarks